US005213666A

United States Patent [19]

Nishino

[11] Patent Number: 5,213,666

[45] Date of Patent: May 25, 1993

[54] METHOD OF PREPARING SUPPORT FOR PRINTING PLATE

[75] Inventor: Atsuo Nishino, Shizuoka, Japan

[73] Assignee: Fuji Photo Film Co., Ltd., Kanagawa, Japan

[21] Appl. No.: 824,531

[22] Filed: Jan. 23, 1992

[30] Foreign Application Priority Data

Jan. 23, 1991 [JP] Japan ..... 3-006506
Oct. 1, 1991 [JP] Japan ..... 3-253205

[51] Int. Cl.[5] ..... C25F 3/04

[52] U.S. Cl. ..... 204/129.43; 204/DIG. 9; 204/129.75

[58] Field of Search ..... 204/129.43, DIG. 9, 204/129.75

[56] References Cited

U.S. PATENT DOCUMENTS 4,272,342 6/1981 Oda et al. ..... 204/129.43 X
4,476,006 10/1984 Ohba et al. ..... 204/17
4,482,434 11/1984 Pliefke ..... 204/DIG. 9 X
4,561,944 12/1985 Sasaki et al. ..... 204/33
4,576,686 3/1986 Hirokazu et al. ..... 204/33
4,588,486 5/1986 Nguyen et al. ..... 204/129.75 X
4,686,021 8/1987 Nakanishi et al. ..... 204/129.75
4,741,812 5/1988 Kojima et al. ..... 204/DIG. 9 X
4,897,168 1/1990 Boergerding et al. ... 204/DIG. 9 X
5,045,157 9/1991 Nishino et al. ..... 204/33

FOREIGN PATENT DOCUMENTS 414189 2/1991 European Pat. Off. .
1532303 11/1978 United Kingdom .

*Primary Examiner*—Donald R. Valentine
*Attorney, Agent, or Firm*—Burns, Doane, Swecker & Mathis

[57] ABSTRACT

A method of preparing a support for a lithographic printing plate which comprises roughing electrochemically the surface of an aluminum plate which is rendered an anode in an aqueous neutral salt solution by supplying pulse-formed electric potential. According to this method uniform deep pits can be obtained easily.

6 Claims, 4 Drawing Sheets

METHOD OF PREPARING SUPPORT FOR PRINTING PLATE

BACKGROUND OF THE INVENTION

This invention relates to a method of preparing a support for a printing plate from an aluminum plate of which the surface is electrochemically roughed.

In general, aluminum plates are used as the support for offset printing plates of which the surface is usually roughed in order to improve adhesion to the photosensitive layer provided thereon, to hold damping water used during printing, and the like.

As the roughing means, mechanical treatments, such as ball graining and brush graining, are known. Recently, electrolytic roughing has been developed wherein the surface of the aluminum plate is roughed electrochemically in an acidic electrolyte solution, such as hydrochloric acid or nitric acid. The surface of the aluminum plate treated with the electric roughing is uniformly roughed with a narrow means roughness distribution compared with the conventional mechanical roughing but the conditions capable of forming the above roughed surface are very restricted. That is, aluminum plates, of which the quality and properties are uniform, can readily be obtained by maintaining constant various conditions, such as the composition of the electrolyte solution, temperature and electrolysis conditions.

However, in the electrolytic roughing conducted in the aqueous solution of hydrochloric acid, nitric acid or the like, the solution is depleted by the aluminum ions eluted by the electrochemical reaction. According, it is necessary to control the aluminum ion concentration and to maintain the hydrochloric acid or nitric acid concentration of the electrolyte solution constant by adding water and hydrochloric acid or nitric acid. Furthermore, it is necessary to eliminate the components, which are harmful to the natural environment, from the electrolyte solution prior to discharging it as a waste liquid. Because of the above reasons, the conventional electrolytic roughing, which is conducted in the aqueous hydrochloric acid solution or the like, was very expensive. The acid can be recovered by using an ion-exchange membrane, but this method requires extensive auxiliary equipment and has a problem in maintenance.

In order to improve the above problems of the electrolytic roughing conducted in the aqueous hydrochloric acid solution or the like, a method proposed is of conducting the electrolytic roughing in an aqueous neutral salt solution by using direct current or alternating current (GB 1532303). This method is preferable in view of low cost, but is insufficient for producing uniform sufficiently deep pits.

SUMMARY OF THE INVENTION

An object of the invention is to provide a method of preparing a support for a printing plate capable of resolving the above problems and capable of forming uniform sufficiently deep pits.

The present inventors investigated in order to achieve the above object, and found that when pulse-formed electric potential is supplied, uniform sufficiently deep pits can be formed. The present invention has been completed based upon the above finding, and provides a method of preparing a support for a lithographic printing plate which comprises roughing electrochemically the surface of an aluminum plate which is rendered an anode in an aqueous neutral salt solution by supplying pulse-formed electric potential.

DETAILED DESCRIPTION OF THE INVENTION

Figure 1:
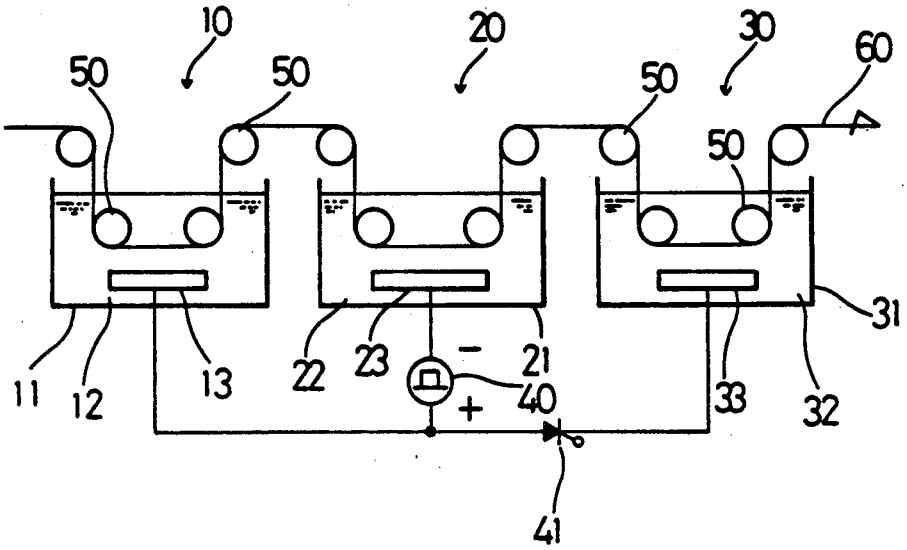
FIG. 1 is a block diagram illustrating a roughing apparatus used for conducting the method of the invention.

The pulse-formed electric potential varies at a prescribed interval at least at an arbitrary point of the treating surface of the aluminum plate. As such a pulse-formed electric potential, pulsed direct current voltage can be used. Alternatively, a plurality of cathode faces is provided along the traveling direction of the aluminum plate at prescribed intervals, and in this state, continuous direct current voltage is applied to produce a pulse-formed standing wave or the like in the electrolytic bath. In the case of the pulsed direct current voltage, lateral defects are liable to be formed perpendicular to the traveling direction of the aluminum plate, and moreover, a power source for generating a special pulse is necessary. Accordingly, the latter means using continuous direct current voltage is preferred. The space between the aluminum plate and the electrode face is preferably 5 to 20 mm.

The pulsed direct current voltage varies its direct current voltage periodically, and is produced by rectifying alternating current by a thyristor, a transistor, a GTO, etc., by converting alternating current to direct current by passing a rectifying device and then chopping the direct current by using an inverter circuit containing a thyristor, a transistor, a GTO, etc., or the like. The pulsed direct current voltage also includes a current having a waveform which is inverted at a short time, disclosed in U.S. Pat. No. 4,897,168.

In the case of using the continuous direct current voltage, a plurality of cathode faces can be provided along the traveling direction of the aluminum plate at prescribed intervals, by disposing a plurality of cathodes at prescribed intervals, by using a long cathode and disposing a plurality of insulators at prescribed intervals between the cathode and the aluminum plate. When a plurality of cathodes is disposed at prescribed intervals, providing partition wall(s) before, after or before and after the cathodes is preferred, because the electric current around the edges of the cathodes can be controlled. As the partition wall, a wall made of an insulative material is disposed in the width direction of the aluminum plate over the whole width of the cathodes with a constant clearance between the aluminum plate and the wall. The length of the partition wall in the traveling direction of the aluminum plate is preferably longer than 5 mm, and the space between the aluminum plate and the partition wall is preferably 1 to 5 mm.

The duty ratio of the pulse-formed electric potential supplied to an arbitrary point of the treating surface of the aluminum plate is preferably 2:1 to 1:9. In the case of using the continuous direct current voltage, the duty ratio can be controlled into the above range by arranging the ratio of the length A of each cathode face opposite to the aluminum plate in the traveling direction of the aluminum plate to the space B between respective cathode faces to 2:1 to 1:9.

The frequency of the pulse-forming electric potential supplied to an arbitraty point of the treating surface of the aluminum plate is preferably 0.1 to 60 Hz, and 0.5 to 2.0 Hz is particularly preferred. In the case of using the continuous direct current voltage, the frequency is set by the length A of the cathode face, the space B between respective cathode faces and the traveling speed V of the aluminum plate, and the frequency f is calculated as $f=V/(A+B)$. Therefore, the frequency can be controlled into the above range by adjusting the length A of the cathode face, the space B between respective cathode faces and the traveling speed V of the aluminum plate.

The current density at an arbitrary point of the treating surface of the aluminum plate is preferably 0.1 to 200 $A/dm^2$, and especially, the current density at an arbitrary point passing the space between cathode faces is preferably 0.1 to 1.5 $A/dm^2$. The current density can be controlled by changing the structure of an electrolytic bath or by providing an auxiliary electrode for galvanizing minor current between both cathodes.

A suitable electrolysis time is 0.1 to 90 seconds. In the case of using pulsed direct current voltage, a suitable rise time and decay time are 0 to 100 msec, and 0 to 3.0 msec is preferred. Since the decay time influences graining especially, to set the decay time into the above range is preferred.

The rise time and decay time of electric current are limited by aluminum phase boundary resistance, the resistance of liquid, the distance between the aluminum plate and electrode, the form of electrode, the cell structure around the edge of electrode (the structure of partition wall), and the like. Therefore, it is necessary to examine in the stage of apparatus design so that these times are entered in the above range. Particularly, the electric potential distribution of the aluminum plate opposite to the electrode can sharply rise and decay by projecting the edge portion of the electrode.

The aqueous neutral salt solutions applicable to the invention are, for example, disclosed in GB 1532303. Suitable neutral salts are alkali metal halides and alkali metal nitrates, and sodium chloride and sodium nitrate, particularly sodium nitrate, are preferred. A suitable pH of the neutral salt solution is 5 to 9, and pH of 6 to 9 is preferable, because most of aluminum ions dissolved out are precipitated in the form of aluminum hydroxide or aluminum oxide hydrate. Moreover, the neutral salt solution is consumed little other than the amount taken out adhered to the aluminum plate. The aluminum precipitate can be removed from the neutral salt solution continuously by filtration or centrifugation. As a result, the cost required for the waste liquid treatment can be reduced. However, when the neutral salt solution having a pH in the above range is used, the pH around the aluminum plate and around the interface of electrode may vary outside of the range of pH 5 to 9. A suitable concentration of the neutral salt is 1 to 40, and a preferable liquid temperature is 35° to 75° C.

As the cathode opposite to the aluminum plate, carbon, stainless steel or the like can be used. A large cathode can be made by arranging separate pieces in a row at intervals of 1 to 5 mm or interposing insulator pieces, such as those made of polyvinyl chloride, 1 to 5 mm in thickness.

The aluminum plate is made of pure aluminum or aluminum alloy.

The aluminum plate is preferably treated with slight etching and any smut (composed primarily of aluminum hydroxide) is removed by dipping in sodium hydroxide, sulfuric acid, nitric acid or the like, electrolytic cleaning in an aqueous neutral salt solution, or the like, before or after the electrolytic roughing is conducted in the aqueous neutral salt solution. The power source for the electric cleaning may be a dedicated one, or the power source for supplying the direct current which is used for the electrolytic roughing may be shared for the electric cleaning. The electrolytic cleaning can be conducted in the same vessel used as the electrolytic bath for roughing by attaching an anode opposite to the aluminum plate, or can be conducted in a separate electrolytic bath.

The aluminum plate thus treated can further be treated with anodic oxidation in an electrolyte solution containing sulfuric acid or phosphoric acid according to the conventional method in order to improve hydrophilic property, water retention and resistance to printing. Moreover, a sealing treatment can be conducted after the anodic oxidation. The aluminum plate may also be rendered hydrophilic by dipping in an aqueous solution containing sodium silicate, etc. Besides, the aluminum plate may previously be treated with mechanical roughing as disclosed in Japanese Patent KOKOKU No. 57-16918, or roughing using alternating current in an aqueous hydrochloric acid as disclosed in U.S. Pat. No. 4,721,552. The etching treatment after the above mechanical or electrochemical roughing may be chemically etching by sodium hydroxide or the like, or electrochemically etching in an aqueous neutral salt solution wherein the aluminum plate is made the negative electrode.

In the roughed surface of the aluminum plate formed by the invention, uniform deep pits are formed in paralle, in a form of a honeycomb.

According to the method of the invention, uniform deep pits are formed on the surface of the aluminum plate, and the roughed surface thus formed is very suitable for the support for a printing plate.

EXAMPLES

Roughing Apparatus

A roughing apparatus which is used for conducting the method of the invention is illustrated in FIG. 1. This apparatus is composed of a first cathode electrolysis portion 10 where the aluminum plate is rendered a cathode and electrolyzed in an aqueous neutral salt solution, a roughing portion 20 where the aluminum plate treated at the cathode electrolysis portion is electrochemically roughed in an aqueous neutral salt solution, and a second cathode electrolysis portion 30 where the aluminum plate roughed at the roughing portion is rendered a cathode and electrolyzed in an aqueous neutral salt solution.

The first cathode electrolysis portion 10 is composed of a cathode electrolytic bath 11 which is provided with an anode 13 on the underside of the bath and is filled with an aqueous neutral salt solution 12. The roughing portion 20 is composed of a roughing bath 21 which is provided with a cathode 23 on the underside of the bath and is filled with an aqueous neutral salt solution 22. The second cathode electrolysis portion 30 is composed of a cathode electrolytic bath 31 which is provided with an anode 33 on the underside of the bath and is filled with an aqueous neutral salt solution 32. Both anodes 13, 33 are connected to the positive terminal of a pulsed direct current power source 40, and the cathode 23 is connected to the negative terminal thereof. A thyristor 41 is provided between the anode 33 of the second cathode electrolysis portion 30 and the pulsed direct current power source 40. Each electrolytic bath 11, 21, 31 is provided with four rollers 50, . . . , 50 to form a traveling passage for the aluminum plate so as to dip the plate into each electrolytic bath.

Figure 2:
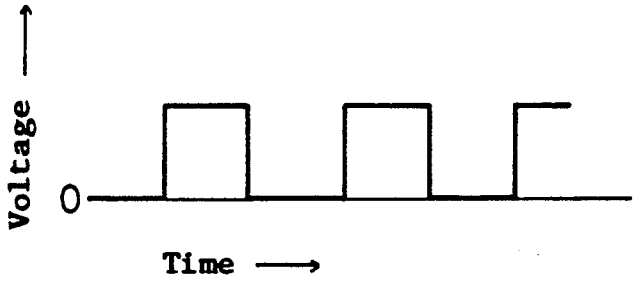
FIG. 2 is a graph of a pulsed direct current used for conducting the method of the invention.

When a support for a printing plate is prepared by using the apparatus shown in FIG. 1, pulsed direct current voltage, such as shown in FIG. 2, is supplied from the pulsed direct current power source 40 to respective neutral salt solutions 12, 22, 32, and the aluminum plate 60 is moved toward the right direction of the figure. Then, the aluminum plate 60 is electrolyzed as a cathode at the first cathode electrolysis portion 10 to clean the surface. Subsequently, the surface of the aluminum plate opposite to the cathode 23 is roughed to a prescribed roughness at the roughing portion 20 by the pulsed direct current voltage. The roughed aluminum plate is electrolyzed as a cathode at the second cathode electrolysis portion 30 to clean the surface again. The electric current to the anode 33 can be controlled by an ignition timing, such as thyrista 41, GTO, or the like.

Figure 3:
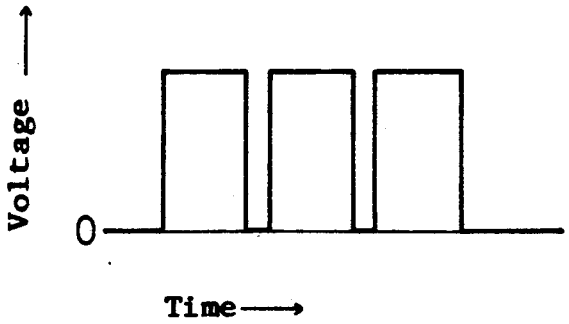
FIG. 3 is a graph of another pulsed direct current used for conducting the method of the invention.

FIG. 3 shows a waveform of another pulsed direct current voltage which has a greater magnitude and shorter intervals than the pulsed direct current voltage.

Figure 4:
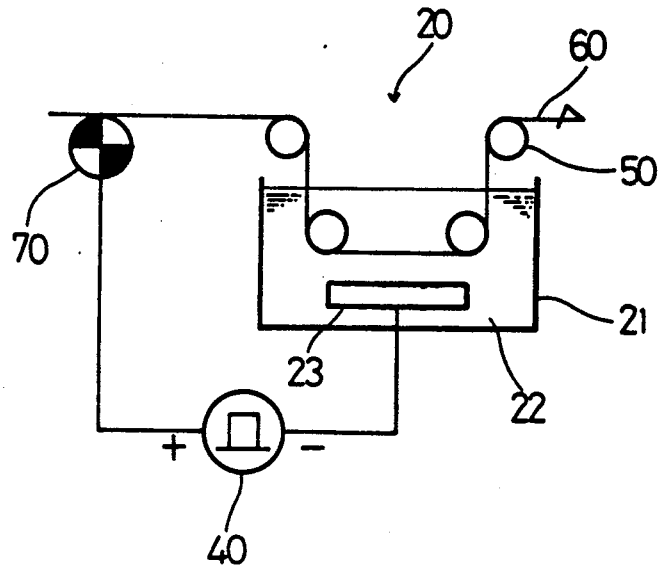
FIGS. 4 and 5 are block diagrams illustrating other roughing apparatuses used for conducting the method of the invention.
Figure 5:
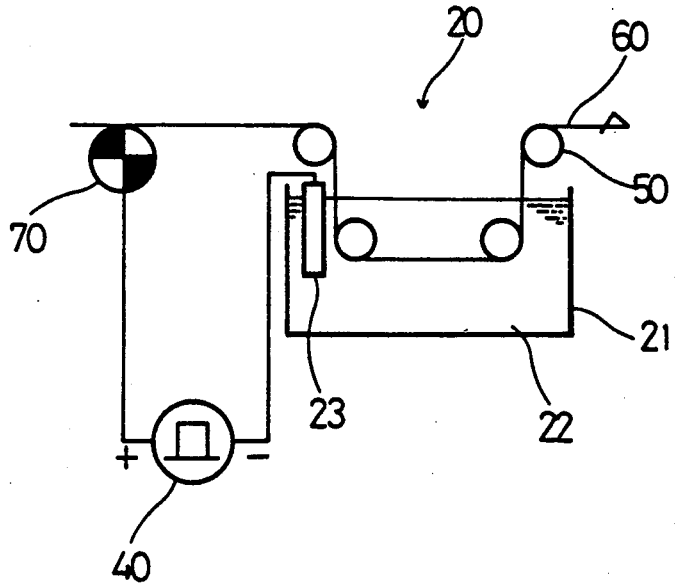

Another roughing apparatus which is used for conducting the method of the invention is shown in FIG. 4. This apparatus also utilizes pulsed direct current voltage, and the same as the roughing portion of the apparatus of FIG. 1, except that the entrance side of the aluminum plate 60 is connected to the positive terminal of the pulsed direct current power source 40 through a conductor roll 70. The cathode 23 may be positioned on the side of the sidewall of the bath 21 as shown in FIG. 5.

Figure 6:
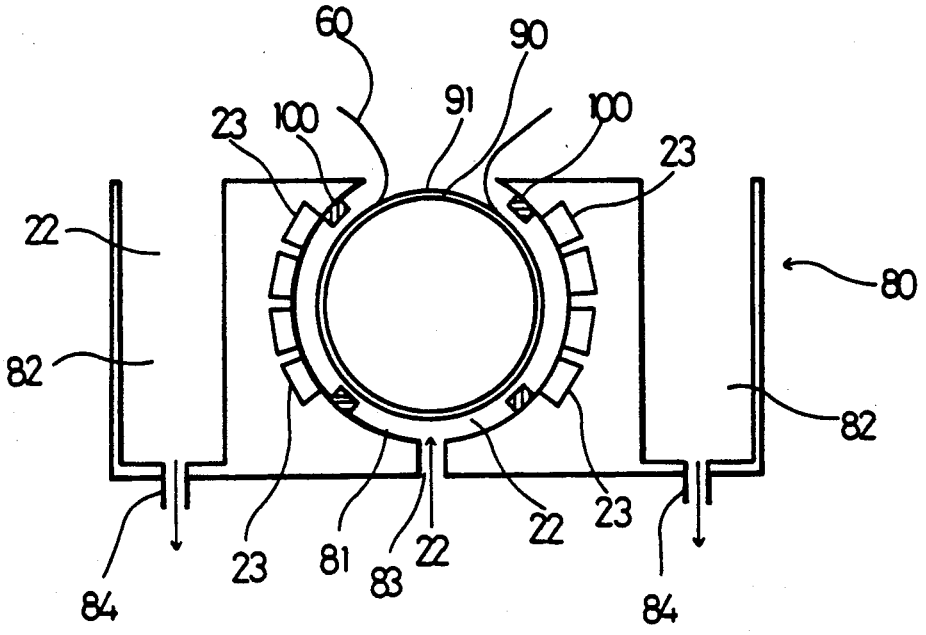
FIG. 6 is a sectional view of another roughing apparatus used for conducting the method of the invention.

The roughing apparatus shown in FIG. 6 utilizes continous direct current voltage, and the electrolytic bath 80 is composed of a treating chamber 81 and oveflow receivers 82, 82 disposed on both sides thereof. The treating chamber 81 is formed into almost a circule in section, and an inlet port 83 for supplying the aqueous neutral salt solution 22 is provided at the bottom portion. The overflow receivers 82, 82 are provided with an outlet port 84 for discharging the received aqueous neutral salt solution 22. The treating chamber 81 is provided with a cylindrical rubber roll 90 rotatably, and a wide metal ring 91 is embedded at the center of the rubber roll 90 in the circumferential direction so as to supply electric current to the aluminum plate 60. The metal ring 91 is connected to the continuous direct current power supply not illustrated through a feeding brush not illustrated, a slip ring not illustrated and a roll shaft not illustrated. Each four cathodes 23, . . . , 23 are embeded on both sidewalls of the treating chamber 81 at regular intervals, and partition walls 100, . . . , 100 for regulating the electric current at the edge portions are provided over the uppermost cathode and under the lowermost cathode, respectively.

Figure 7:
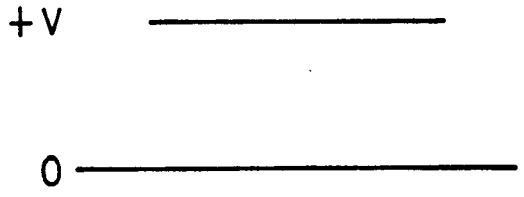
FIG. 7 is a graph of a direct current before pulsed.

When a support for a printing plate is prepared by using the shown in FIG. 6 apparatus, continuous direct current voltage, such as shown in FIG. 7 is supplied, and the aluminum plate 60 wound around the rubber roll 90 and contacted with the metal ring 91 is moved by the rotation of the rubber roll 90. Then, pulse-formed electric potential is supplied to the aluminum plate 60, and uniform deep pits are formed on the surface of the plate without lateral defects.

Figure 8:
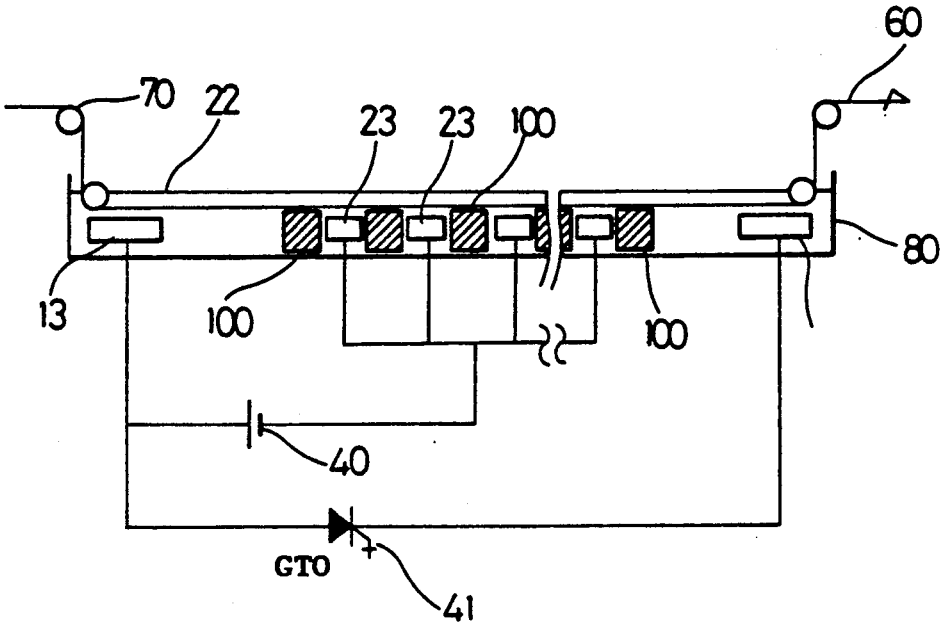
FIGS. 8 and 9 are block diagrams illustrating still other roughing apparatuses used for conducting the method of the invention.

Another roughing apparatus utilizing continuous direct current voltage is shown in FIG. 8. The electrolytic bath 80 is filled with an aqueous neutral salt solution 22 and is provided with anodes 13, 33 on both ends, and many cathodes 23, . . . , 23 are provided at the middle portion interposed between partition walls 100, . . . , 100. Each cathode 23 is connected to the cathode of the continuous direct current power source 40 in parallel, and both anodes 13, 33 are connected to the anode of the continuous direct current power source 40 in parallel. A GTO 41 is provided between the anode 33 and the anode of the direct current power source 40. Four pass rolls 70, . . . , 70 are provided to form a traveling passage of the aluminum plate so as to dip the plate into the eletrolytic bath 80.

When a support for a printing plate is prepared by using the apparatus shown in FIG. 8, the continuous direct current voltage is supplied from the direct current power source 40 to the aqueous neutral salt solution 21 and the aluminum plate 60 is moved in the right direction of the figure. Then, the aluminum plate 60 is electrolyzed as a cathode to clean the surface. Subsequently, the aluminum plate 60 becomes an anode, and the surface is roughed at a prescribed depth. The aluminum plate is electrolyzed as a cathode, and the surface is cleaned again.

Figure 9:
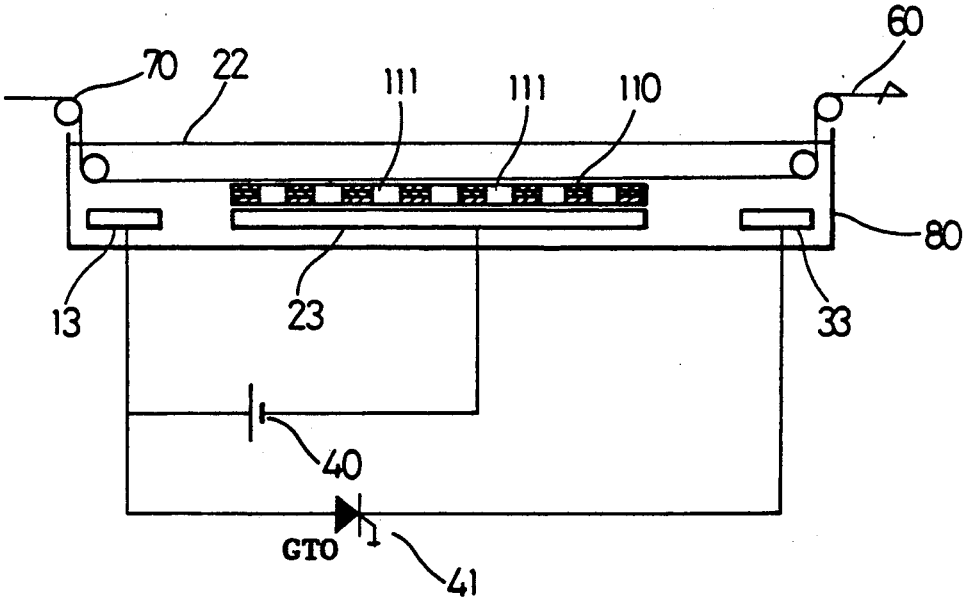

The roughing apparatus of FIG. 9 is the same as the roughing apparatus of FIG. 8, except that one long cathode 23 is used, and a slit plate 110 provided with many slits 111 at regular intervals is disposed on the cathode 23. The slit plate 110 also functions as partition walls.

Preparation of Support for Printing Plate

Example 1

A JIS 1050-H18 aluminum plate was washed with aqueous sodium hydroxide solution, and then washed with water. Subsequently, 1 Hz pulsed direct current having a duty ratio of 1:1 was supplied to the aluminum plate in an aqueous sodium nitrate solution containing 120 g/l of nitrate ions, and thereby the surface of the aluminum plate was roughed. Aluminum hydroxide produced by the electrolytic roughing was removed from the roughed aluminum plate by immersing in 300 g/l sulfuric acid aqueous solution at 60° C. for 20 seconds, followed by washing with water.

Comparative Example 1

The roughing treatment was conducted similar to Example 1, except that 1 Hz alternating rectangular current was supplied instead of the pulsed direct current.

Comparative Example 2

The roughing treatment was conducted similar to Example 1, except that continuous direct current was supplied instead of the pulsed direct current.

Each roughed surface obtained by the above three examples was observed by a scanning electron microscope, and the results are shown in Table 1.

TABLE 1

| | Current | Waveform | Roughed Form |
|---|---|---|---|
| Example 1 | DC | 1 Hz Pulse | Uniform |
| Comparative 1 | AC | 1 Hz Rectangular | Uneven |
| Comparative 2 | DC | Continuous | Slightly Uniform |

As shown in Table 1, in Example 1, more uniform roughed surface was obtained than Comparative Examples. The mean pit diameter of the roughed surface obtained by Example 1 was about 5 μm, and uniform pits were formed on the flat portion Example 2

A JIS 1050 aluminum plate was washed by immersing continuously in 5% sodium hydroxide aqueous solution, and then washed with water. The aluminum plate was then immersed in 25% sulfuric acid aqueous solution, and washed with water. The aluminum plate was roughed by using the roughing apparatus shown in FIG. 5. 1 Hz rectangular pulsed direct current voltage was supplied to the aluminum plate, and the traveling speed of the aluminum plate was adjusted so that the quantity of electricity loaded on the aluminum plate became 600 C/dm$^2$. The current density was 80 A/dm$^2$ at the maximum value of the rectangular pulsed current waveform. The aqueous neutral salt solution filled in the electrolytic bath was sodium nitrate aqueous solution of which the nitrate ion concentration was adjusted to 80 g/dl, and the temperature was 45° C. The roughed surface of the aluminum plate was observed, and lateral defects was found perpendicular to the traveling direction of the aluminum plate corresponding to 1 Hz cycle. Aluminum hydroxide produced by the electrolytic roughing was removed from the roughed aluminum plate by immersing in 300 g/l sulfuric acid aqueous solution at 60° C. for 20 seconds, followed by washing with water. The roughed surface was observed by a scanning electron microscope at about 1,000 magnifications, and honeycomb pits were obserbed.

Example 3

A JIS 1050 aluminum plate was washed by immersing in 5% sodium hydroxide aqueous solution, and then washed with water. The aluminum plate was then immersed in 25% sulfuric acid aqueous solution, and washed with water. The aluminum plate was roughed using the roughing apparatus shown in FIG. 6. The rubber roll 90 was rotated at 0.25 rotation/sec so that the cycle of electric potential loaded on the aluminum plate became 0.5 Hz. The current density of the continuous direct current was 100 A/dm$^2$. The roll was rotated until the quantity of electricity loaded on the aluminum plate became 600 C/dm$^2$. The aqueous neutral salt solution filled in the electrolytic bath was sodium nitrate aqueous solution of which the nitrate ion concentration was adjusted to 80 g/l, and the temperature was 45° C. Aluminum hydroxide produced by the electrolytic roughing was removed from the roughed aluminum plate by immersing in 300 g/l sulfuric acid aqueous solution at 60° C. for 20 seconds, followed by washing with water. The roughed surface was observed by a scanning electron microscope at about 1,000 magnifications, and honeycomb pits were observed.

The results of Examples 2 and 3 are shown in Table 2.

TABLE 2

| | Surface Quality | Surface Form |
|---|---|---|
| Example 2 | C lateral defects | B |
| Example 3 | B | B |

A: Excellent
B: Good
C: Fair

Example 4

A JIS 1050 aluminum plate was washed by immersing in 5% sodium hydroxide aqueous solution, and then washed with water. The aluminum plate was then immersed in 25% sulfuric acid aqueous solution, and washed with water. The aluminum plate was roughed by using the roughing apparatus shown in FIG. 6. The rubber roll 90 was rotated so that the cycle of electric potential loaded on the aluminum plate became 0.5 Hz, 1 Hz, 2 Hz. Moreover, the duty ratio of the electric potential loaded on the aluminum plate was changed to 1:1, 1:3 by changing the length of the electrodes. The partition walls were attached before and after the electrodes are attached. The current density of the continuous direct current was 100 A/dm$^2$. The roll was rotated until the quantity of electricity loaded on the aluminum plate became 600 C/dm$^2$. The aqueous neutral salt solution filled in the electrolytic bath was sodium nitrate aqueous solution of which the nitrate ion concentration was adjusted to 80 g/l, and the temperature was 45° C. Aluminum hydroxide produced by the electrolytic roughing was removed from the roughed aluminum plate by immersing in 300 g/l sulfuric acid aqueous solution at 60° C. for 20 seconds, followed by washing with water. The white roughed surface was observed by a scanning electron microscope.

The results are shown in Table 3.

TABLE 3

| Partition Wall | Present | | Abstract | |
|---|---|---|---|---|
| Duty Ratio | 1:1 | 1:3 | 1:1 | 1:3 |
| Electric Potential Cycle | | | | |
| 0.5 Hz | B | B–C | B | A–B |
| 1.0 Hz | C | C | B | — |
| 2.0 Hz | C | C | B | — |

A: Excellent
B: Good
C: Fair

I claim:

1. A method of preparing a support for a lithographic printing plate which comprises roughing electrochemically the surface of an aluminum plate which is rendered an anode in an aqueous neutral salt solution by supplying pulse-formed direct electric potential.

2. The method of claim 1 wherein the aluminum plate is moved over a plurality of cathode faces and said pulse-formed electric potential is generated by impressing continuous direct current voltage on the plurality of cathode faces provided along the direction of movement of the aluminum plate at predetermined intervals in the aqueous neutral salt solution.

3. The method of claim 1 wherein each cathode is interposed between partition walls.

4. The method of claim 1 wherein the duty ratio of the pulse-formed electric potential is 2:1 to 1:9.

5. The method of claim 1 wherein the frequency of the pulse-formed electric potential is 0.5 to 2.0 Hz.

6. The method of claim 1 wherein said aqueous neutral salt solution is aqueous sodium nitrate solution having a pH of 6 to 8.

* * * * *